United States Patent [19]

Cunningham

[11] Patent Number: 5,056,232

[45] Date of Patent: Oct. 15, 1991

[54] REMOTE LIGHT SOURCE RESPONSIVE VISUAL TIME INDICATOR

[75] Inventor: Timothy F. Cunningham, Spokane, Wash.

[73] Assignee: B. Sirius Toys, Inc., Millville, N.J.

[21] Appl. No.: 573,480

[22] Filed: Aug. 24, 1990

[51] Int. Cl.[5] ..... G04B 49/00

[52] U.S. Cl. ..... 33/269; 33/270

[58] Field of Search ..... 33/268–271

[56] References Cited

U.S. PATENT DOCUMENTS

| | | | |
|---|---|---|---|
| 89,585 | 6/1869 | Johnson | 33/270 |
| 783,245 | 1/1905 | Clarke | 33/270 |
| 933,556 | 9/1909 | Hansen | 33/270 |
| 1,674,161 | 2/1928 | De Bogory | 33/270 |
| 2,594,600 | 4/1952 | Upton | 33/271 |
| 2,846,768 | 11/1958 | Putnam | 33/270 |
| 3,031,763 | 5/1962 | Jewett | 33/270 |
| 3,815,249 | 6/1974 | Gundlach | 33/269 |
| 4,255,864 | 1/1981 | Glendinning | 33/270 |
| 4,338,727 | 7/1982 | Gundlach | 33/269 |
| 4,373,270 | 7/1983 | Ousley | 33/270 |
| 4,384,408 | 5/1983 | Bohlayer | 33/270 |
| 4,782,472 | 6/1988 | Hines | 33/270 |
| 4,835,875 | 6/1989 | Fuller | 33/270 |

FOREIGN PATENT DOCUMENTS

| | | | |
|---|---|---|---|
| 2467427 | 5/1981 | France | 33/269 |
| 2604000 | 3/1988 | France | 33/268 |

*Primary Examiner*—Allan N. Shoap
*Assistant Examiner*—Alvin Wirthlin
*Attorney, Agent, or Firm*—Wells, St. John & Roberts

[57] ABSTRACT

A remote light source responsive time indicator includes a preferably cylindrical body of transparent material with a light receiving and refracting surface on one side and an axial image producing surface on a remaining side. The image producing surface may be formed as a translucent surface on the body, integrated therewith or applied thereto. Angularly spaced axial time indicia is also provided on the image producing side. The body is preferably supported on a base so the light receiving and refracting side faces upwardly and the image producing side faces downwardly. Sunlight received through the light receiving and refracting surface is concentrated optically through the transparent body and an intense visible image of the light is made to appear on the opposite side by provision of the image producing surface. This image moves with the sunlight across the image producing surface and indicates time in hourly increments when associated with the angularly spaced indicia. A second body may also be provided and is held horizontal to indicate seasonal time changes. The second body makes use of similar light receiving and image producing surfaces, with seasonal indicia provided in place of the hourly indicia. The bodies may be rotated about their respective central axes to facilitate initial time and seasonal settings.

30 Claims, 4 Drawing Sheets

74
71
10
75
72
73
70
80
81
0°

REMOTE LIGHT SOURCE RESPONSIVE VISUAL TIME INDICATOR

TECHNICAL FIELD

The present invention relates to horology and more particularly to light responsive time indicators using optical properties of light refraction through a body of transparent material.

BACKGROUND OF THE INVENTION

Light responsive time indicators have been in use since early history. An early example of such time indicators is the sundial. The typical sundial includes a flat base and an upright gnomon. The base is marked with angularly disposed indicia. When the apparatus is correctly positioned in relation to the sun, a shadow of the gnomon will fall across a time calibration.

Various other forms of "sundials" typically involve ancient principles empolying the gnomon and its shadow to indicate time against calibrated indicia. Others have made direct use of sunlight by screening the light around slots or through pin holes. One such device is shown in U.S. Pat. No. 4,255,864 to Glendinning. This patent discloses a sun clock in which the top of a hollow box is provided with a light receiving slit. Sunlight is received through the slit and projects onto a calibrated shaded area of the box below. The beam of sunlight is used to indicate the time.

A "pin hole" sundial is exemplified by U.S. Pat. No. 89,585 to J. Johnson. This device makes use of a hollow sphere with a pin hole opening on one side. Sunlight received through the opening projects against the backside of a graduated surface on the sphere. A dot of light appears on this surface in a position related to time calibration to indicate both hourly time and month.

A combination slit and gnomon sundial arrangement is exemplified in 1905 U.S. Pat. No. 783,245 to S. M. Clarke. This device makes use of a hollow triangular box with a slit formed on either side of a gnomon. The slits and gnomon are applied on an angular surface of the box that is positioned to face the sunlight. A translucent surface marked with hourly indicia is on an opposite of the box. The sun's rays are received through the slit and are blocked by the gnomon so bright areas on opposed sides of the gnomon shadow appear on the translucent surface adjacent the time indicia.

U.S. Pat. No. 4,782,472 to Hines was granted in 1988 for a solar clock with digital time display. A cylindrical light gathering tube with slots receive sunlight. The slots are angularly positioned so that direct light is received only at specified times through a day. The sun rays received through the openings are projected against the opposite inside surface of the tube where receptor ends of "fiber optic" filaments are attached. Light other than the direct light coming from the sun through a selected slot will be diffused at areas other than the specific position at which the fiber optic end is situated. Various strands of the fiber optic are connected to a "digital" display. Intensified light, occurring when particular slots are in direct alignment with the sun, show up as bright images on the digital display, arranged to visually represent the proper time.

Many other forms of light screening and reflecting apparatus have been used for time indicators. However, the difficulty with such arrangements is that the light, contrary to many of the examples shown, diffuses through a pin hole into various shapes according to the current angular relation of the apparatus to the sun. The shape of a "dot" or "line" projected through an opening also depends upon the proximity of the surface against which the ray or shadow projects. Thus, there is inconsistency and, hence, inaccuracy inherent in these indicators.

The above problem has been partially resolved to by light refractive time indicators in which light is concentrated through a lens and is focused outside the lens on a particular calibrated surface. For example, U.S. Pat. No. 1,674,161 to Bogory discloses a time measuring device in which a transparent sphere is used to focus sunlight on a hollow sphere of "metallic screen or some other semi-transparent or transparent material". The hollow sphere is concentric with the center of the transparent sphere and set at a radius such that the inner surface of the hollow sphere is at the focus of the transparent sphere. Thus, light is concentrated through the transparent sphere to form a bright dot on the inner surface of the hollow sphere. A third outward sphere is provided with indicia that is selectively visually aligned with the dot on the internal sphere to indicate time and season or month. This device, while apparently very effective, is also quite complicated and expensive to produce.

A somewhat simpler example of a light responsive "clock" is shown in the 1958 U.S. Pat. No. 2,846,768 to Putnam. This patent discloses a "sundial" in which the sun's rays are received through a substantially cylindrical lens. The sun's rays are focused through the lens onto a transverse flat plate that encircles the cylindrical lens. The plate is formed of translucent material and is marked with radial calibrations to indicate the time. The sun's rays are refracted through the cylindrical lens and appear on the surface of the disk as a wedge of light, the apex of which is associated with a current time marking. This device functions well and is substantially simpler and easier to manufacture than the spherical type indicator.

Another transparent block refractive type indicator is exemplified in U.S. Pat. No. 4,373,270 to Russell M. Ousley. This patent discloses a light transmissive sundial formed of a semicylindrical transparent block. A base of the semicylindrical body is angled so a surface of the block faces angularly upward to face the sun. Spaced transparent surfaces are arranged axially along the semicylindrical surface of the body and are spaced apart 15° from one another in relation to the axis of the body. The axial surfaces are flat in relation to the central axis of the dial. This is done evidently to minimize refraction through the solid transparent material. Concave recesses or flutes between adjacent flat transparent surfaces are darkened to eliminate passage of sunlight between the various flat transparent surfaces.

The opposite side of the transparent body is planar, with an axial notch or groove formed along the apparent central axis for the opposed semicylindrical surface. The notch is used as a reference. The bottom surface of the body is marked with time indicating characters. These characters are visible axially from the top end of the body. The viewer must position the device on a flat surface, orient the semicylindrical surface toward the sun, and compare various rays of sunlight that become visible when looking down through the device. The correct time is discerned by judging which of the light rays appears closest to the reference notch formed at the apparent center of the semicylindrical surface.

Manufacture of the Ousley device is quite complex. The alternating transparent flat surface and concave flutes are quite difficult to produce in actual practice. Still further, the user may experience some difficulty in judging which of the rays appears to be closest to the central slot and then tracing the ray back to the appropriate time indicating character.

A need has therefore remained for a light responsive time indicator that is both simple to manufacture and easy for the operator to set up and read.

BRIEF DESCRIPTION OF THE DRAWINGS

The preferred embodiment of the invention is illustrated in the accompanying drawings, in which.

DETAILED DESCRIPTION OF THE PREFERRED EMBODIMENTS

The following disclosure of the invention is submitted in furtherance with the constitutional purpose of the Patent Laws "to promote the progress of science and useful arts" (Article 1, Section 8).

Figure 1:
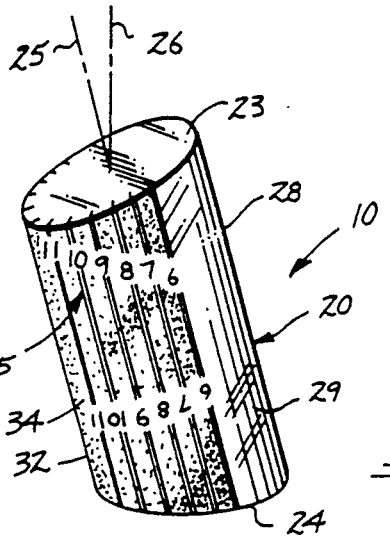
FIG. 1 is a perspective view of a basic configuration of the present invention.
Figure 4:
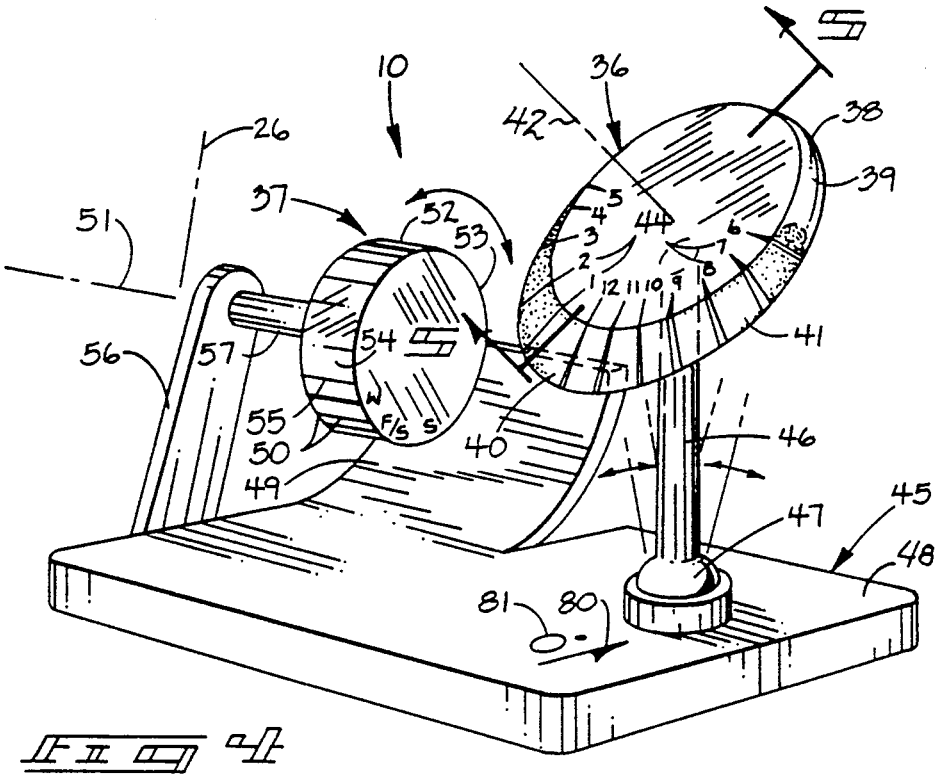
FIG. 4 exemplifies a version of the present time indicator including both hourly and seasonal indicating light refractive bodies.
Figure 7:
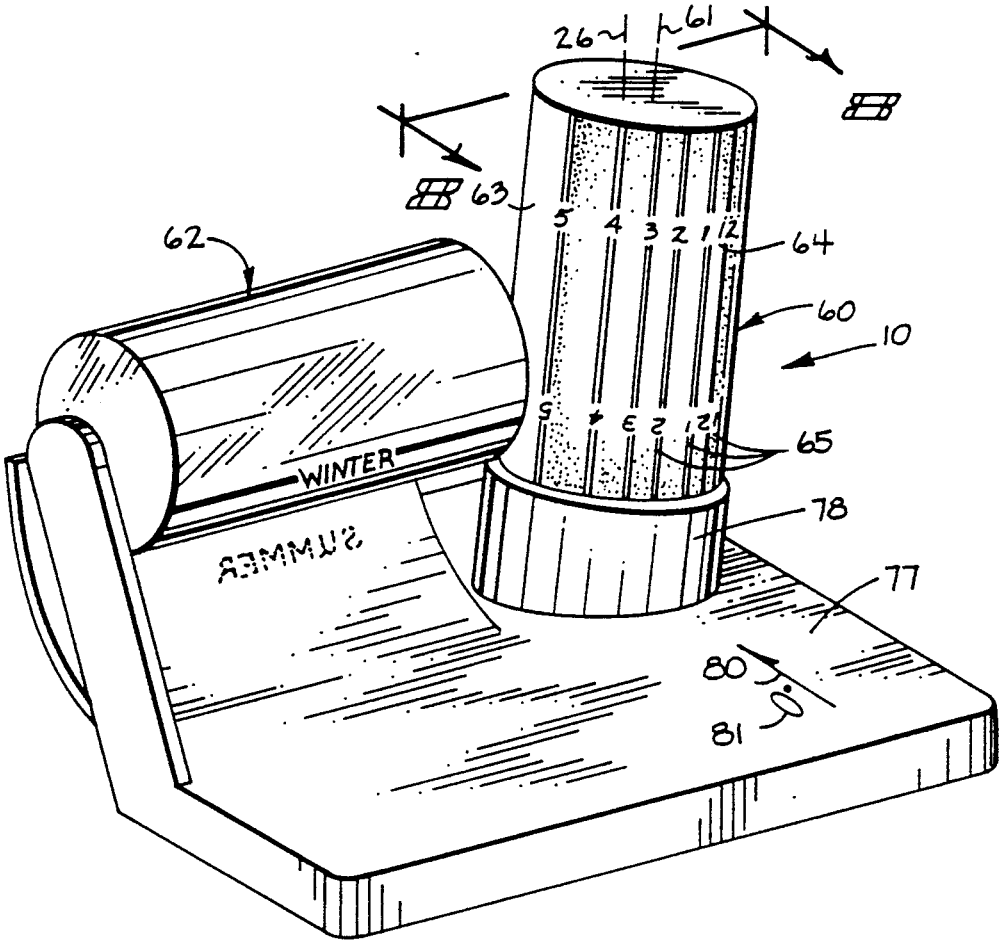
FIG. 7 is a perspective view of another exemplary configuration of the present time indicator.
Figure 9:
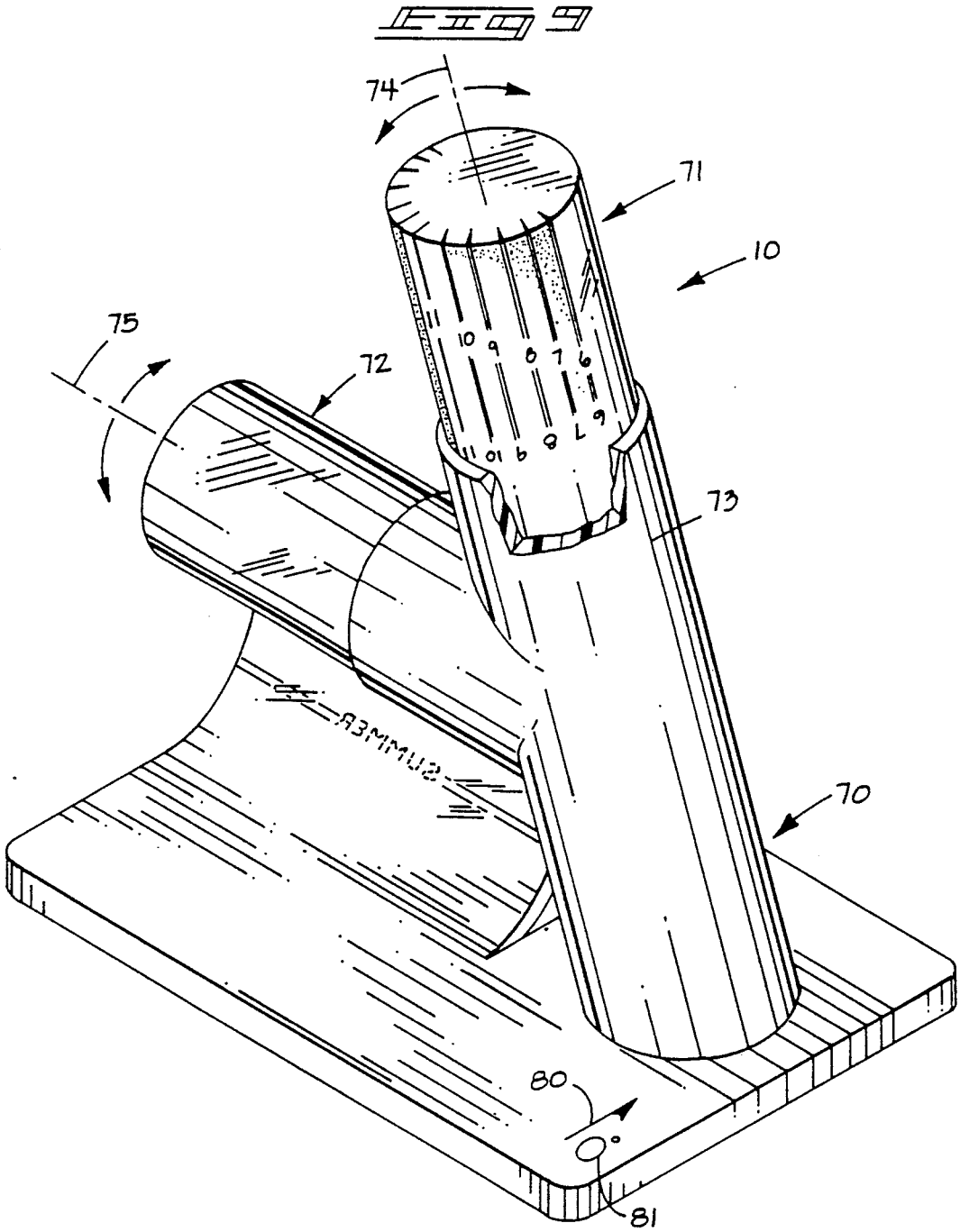
FIG. 9 is a perspective view of the present time indicator with an alternate base configuration.

Various configurations of the present visual time indicator are shown by the reference numeral 10 in the accompanying drawings. The basic configuration is shown in FIG. 1, incorporating features that are also shown in FIGS. 4, 7, and 9. It will be understood that the various configurations and components thereof may be interchanged and modified as suggested herein without departing from the scope of the present invention.

All forms of the present time indicator 10 are responsive to a remote light source. Preferably the light source is the sun. However, the present time indicator 10 will respond to other light sources that have the capability of moving in timed relation to the time indicator as does the sun from one horizon to the other.

In general, the present visual time indicator 10 is comprised of a transparent light refractive body 20. In a preferred form, the body 20 is substantially cylindrical and is comprised of a clear rigid material such as cast acrylic, glass, crystal or other preferably clear optical quality material. Alternatively, the body may be transparent but hollow for receiving a transparent liquid as shown in the variation exemplified in FIG. 8.

The body 20 includes a continuous arcuate external surface formed about a central axis 25 and extends along a central axis 25 between a top end 23 and a bottom or base end 24. In the basic embodiment shown in FIG. 1, the base end 24 is angled such that the central axis 25 is offset angularly between 5° and 45° to nadir 26. Preferably, this angle is approximately 15° to nadir 26. As used herein, the term nadir may be considered as a reference line or axis that is upright or radial in relation to the curvature of the earth's surface. Thus, nadir 26 is a vertical reference and the central axis 25 is angularly offset from the nadir reference 26 by an angle as set forth above.

The angular orientation of the transparent light refractive body 20 is accomplished to orient a transparent light receiving and refracting surface 28 thereon angularly upward to face the light source. The transparent light receiving and refracting surface 28 is provided on a first side 29 of the light refractive body 20. Surface 28, along with the refractive properties of the transparent material comprising the body, concentrates light received therein to produce a concentrated axial column of light 31 (FIG. 3) on an opposite second side 32 of the body 20.

Figure 3:
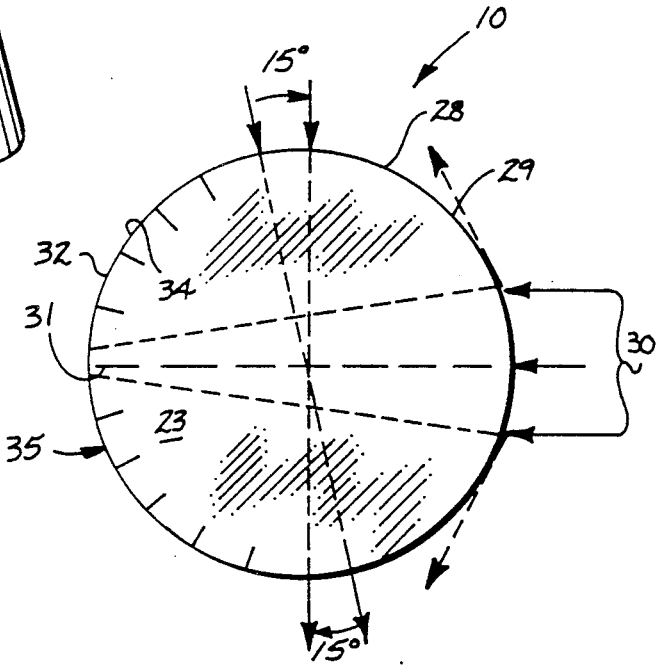
FIG. 3 is a diagrammatic view illustrating the refractive properties of the present time indicator.

The surface 28 is preferably cylindrical so that portions of the surface will reflect light as shown in FIG. 3. Those areas most directly facing the sun will admit light along a narrow axial bar or column 30. The surface 28 and refractive material of the body concentrate and reduce the column to the image size shown at 31 in FIG. 3. This image 31 is consistent regardless of the angular orientation of the sun about the body axis 25.

In order to permit visualization of the concentrated axial column of light 31, an axial image producing surface 34 is provided on the second side 32. The preferred axial image producing surface 34 is integral with the light refractive body 20, being formed by etching or translucent "frosting".

Figure 2:
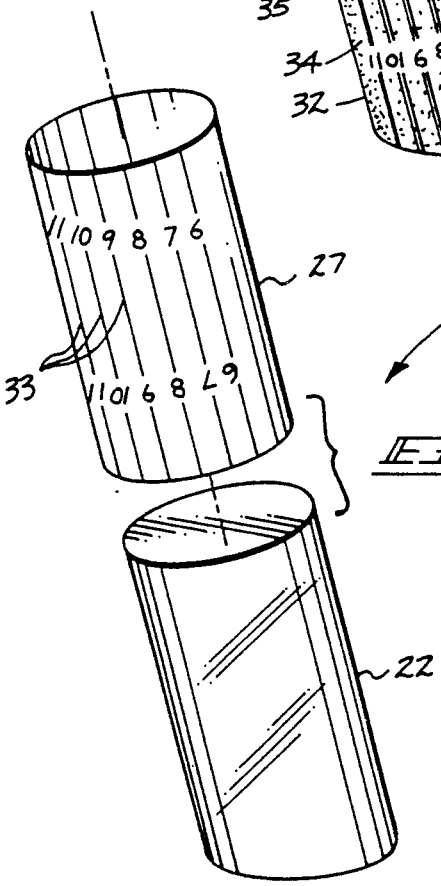
FIG. 2 is an exploded perspective view of a version with a sleeve to be applied over a light refractive body.

It should be understood however that the axial image producing surface 34 may otherwise be applied to side 32 as a coating, as a lamination, or as a sleeve of thin material having desired translucent properties substantially as shown in FIG. 2.

The axial image producing surface 34 enables the light refractive body to visibly display an axial concentrated column of light as refracted through the body directly from surface 28. It is pointed out that without the surface 34, however provided on the light refractive body 20, no visible image would be visible. The present time indicator 10 makes novel use of the actual surface 34 on the second side 32 to produce the image, thereby eliminating extraneous and complicated visualizing apparatus as used by prior light refractive "sundials".

It is preferred that the transparent light receiving and refracting surface 28 extend approximately 180° about the central axis 25 and along the first side 29. It is also advantageous that the axial image producing surface 34 extend the remaining 180° about the central axis 25 on the second side 32. The opposed surfaces, 28 and 34, are oriented in relation to the angular bottom or base end 24 such that the image producing surface 34 faces downwardly in relation to nadir and the light receiving and refracting surface 28 faces upwardly.

Calibrated indicia 35 or time markings as provided on the second side of the transparent light refractive body 20 substantially diametrically opposed to the axial transparent light receiving and refracting surface 28. The calibrated indicia 35 includes time increments 33 that are visually related to the axial column of light that appears in sunlight on the axial image producing surface 34. The calibrated indicia 35 preferably includes hourly increments spaced at 15° between successive indicia markings. The 15° increments correspond to the angle (15°) through which the earth rotates during each hour of a 24-hour day. Thus, for a 360° rotation of the earth, each of the 24 hours represents a 15° angle increment of rotation.

Two separate sets of hourly increments may be provided on the body to enable use of the device in the Northern and Southern Hemispheres, as shown on the FIGS. 1, 2, 7, and 9 variations. This provision may also be made on any other variation of the present indicator 10.

The set shown upright in the above referenced Figures is to be used in the Northern Hemisphere and reads right to left (morning to evening). The inverted set is for use in the Southern Hemisphere and reads left to right (when upright). To accurately tell time in the Southern Hemisphere, the user may simply invert the increments to bring the correct set into it's proper upright orienation.

It is pointed out that the calibrated indicia 35 is on the second side 32 of the body 20 and is superimposed over the axial image producing surface 34 or is integrated with the surface 34. FIG. 1 shows the indicia superimposed over the image producing surface 34. Thus, the column of light 31 may be continuously visible on the surface 32 during daylight hours.

Alternatively, the individual 15° calibrated indicia may be formed as axially etched translucent lines or patterns, or as translucent strips, taped, painted or otherwise applied to an otherwise transparent body (not shown). The concentrated axial column of light will then progressively illuminate each increment as the sun crosses the sky, and will not be visible between the individual sucessive increments.

The above describes the present visual time indicator in general terms as related to the basic form exemplified in FIG. 1 of the drawings. The features described above are also included in variations of the present time indicator exemplified in FIGS. 2, and 4–9 of the drawings.

In the variation of time indicator 10 shown in FIG. 2, a body 22 is provided substantially as shown in FIG. 1, but with calibrated indicia 33 applied on a sleeve 27. The sleeve 27 fits slidably and intimately over the substantially cylindrical body 22. In this variation, the image producing surface as described above at 35 may alternatively be provided on the sleeve 27, indicia 33, or body 22. The indicia 33 on the other hand is advantageously provided on the sleeve 27, so the sleeve 27 may be selectively rotated on the body 22 to "set" the time as will be discussed further below.

Figure 5:
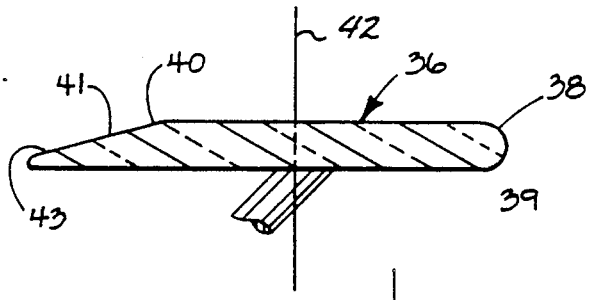
FIG. 5 is a sectional view taken substantially along line 5—5 in FIG. 4.

The variation of the visual time indicator 10 shown in FIG. 4 includes two light refractive bodies, a first body 36 and a second body 37. The first body 36 is a variation of the configuration shown in FIG. 1. Body 36 includes a transparent light receiving and refracting surface 38 on a first side 39 and an axial image producing surface 40 on a second side 41. The first side 39 is relatively narrow along the central axis 42 of the body. Thus, the body 36 is in the shape of a disk. The opposed surfaces 38, 40 represent variations of the light refractive and image producing surfaces 28, 34 described above. The transparent light receiving and refracting surface 38 may be axially convex as shown in FIG. 5. to improve light gathering and concentrating capabilities.

The axial image producing surface 40 may be formed in a beveled frusto-conical configuration surface 43. The surface 43 is provided to produce a substantially axially visible image. The surface 43 is provided with calibration indicia 44 that is spaced like the indicia 35 described above, at 15° angular increments.

The disk is mounted to a base 45 for selective angular and rotational adjustment as indicated by the arrows in FIG. 4. The base 45 includes a post 46 secured by a ball joint arrangement 47 to a relatively flat support surface 48.

The first body 36 is preferably angularly oriented with its central axis 42 situated at an angle between 5° and 45° and preferably at approximately 15° to nadir as disclosed above. The upright post 46 and associated ball and socket 47 can be utilized to accommodate this adjustment.

A portion of the flat base surface 45 includes an upturned reflecting surface 49 that is situated adjacent to the second body 37. This surface acts as a reflecting surface (FIG. 6) to enhance the user's ability to see seasonal indicia 50 supplied as calibration indicia (FIG. 4) along the second body 37.

The second body 37 is structurally and optically similar to the cylindrical body shown in FIG. 1 and described in detail above. The primary differences are simply that the second body 37 is held approximately horizontally and is supplied with different, seasonal indicia 50 to indicate seasonal changes rather than hours.

The second body 37 is supported with its central axis 51 substantially horizontal in relation to nadir 26. Body 37 is selectively rotatable on it's horizontal axis 51 to enable upward exposure of its transparent light receiving and refracting surface 52 on a first side 53. Surface 52 is selectively oriented upwardly to receive and refract light through the transparent body 37 to a concentrated axial column (similar to column 31 shown diagrammatically in FIG. 3) on an image producing surface 55 on the opposed second side 54. Side 54 is provided with seasonal indicia 50 to enable season identification by visual relation to the axial column of light appearing on the seasonal indicia 50.

The second body 37 is supported by an arm structure 56 with a pivot 57 that facilitates rotational adjustment of the second body 37 about its horizontal axis 51. Pivot 57 facilitates rotational adjustment on axis 51 to initially set the device so the column of light appearing along the image producing surface 55 intersects with indicia 50 that identifies the current season in which the time indicator is functioning (winter, spring/fall, and summer).

The seasonal indicia 50 on the second body 37 includes three equally spaced markings, respectively identifying winter, spring/fall, and summer seasons. Spacing between the markings represents the angular position of the earth relative to the sun in each season.

Starting with the spring or fall equinox the sun is positioned midway in its apparent endless circuit of seasonal movement across the sky. As time passes from autumnal equinox to winter solstice, the earth tips downward through an angle of 23.5° in relation to the sun. During the time from winter solstice to the vernal equinox (spring), the earth tips back upward through the same angle of 23.5°. As the season turns from spring to summer, the earth continues its upward motion, another 23.5° from spring equinox to summer solstice. To complete the circuit, the earth tips 23.5° back downward again from summer solstice to fall equinox.

Thus the sun appears to move through a loop or figure "8" circuit of 47°, split at the center of its eternal circuitous movement by the spring and fall equinox and bounded at opposed ends of its loop by the summer and winter soltices, each 23.5° from equinox.

To accurately reflect the seasonal changes, the seasonal indicia markings are spaced apart about the horizontal axis 51 by angles of 23.5°, matching the angle through which the earth moves during seasonal changes. Thus the summer marking is 23.5° to one side of the central spring/fall marking and the winter marking is spaced 23.5° to the opposite side of the spring/fall marking.

A version of the present indicator 10 is shown in FIG. 7 in which the first body 60 is elongated along its central axis 61. The second body 62 is similarly elongated. This arrangement thus exemplifies the fact that the first and second bodies may have any reasonable dimensional configuration along the central axes thereof, so long as the remaining criteria of transparent first and translucent second surfaces are met.

Thus, the first body 60 will include a transparent light receiving and refracting surface 63 extending approximately 180° about its central axis and facing angularly upwardly toward the light source. An axial image producing surface 64 is opposite the surface 63 for the purpose as described above to visually display an axial column of light positioned angularly about the surface in response to the angular orientation of the light source (sun).

The first body 60 is set within the prescribed range of 5° to 45° to nadir and the surfaces 63, 64 are correspondingly positioned such that light will be received through the refracting surface 63 to produce the image on the image producing surface 64. Indicia 65 identical to that described above in reference to the basic form shown in FIG. 1 may be provided along the axial length of the body, in increments also as described above.

Second body 62 is identical in all respects to the second body 37 of the variation shown in FIG. 4. The notable difference is that it includes a longer length dimension along it's axis and the first body 60 is removably and rotatably mounted to a socket 78 on it's base 77. The socket 78 thus allows the body to (a) be rotated (to set the hourly increments in correspondence with the position of the sun) and to (b) be removed to enable the user to select the proper set of hourly increments according to the Hemisphere in which the indicator is being used. The optical properties and indicia markings are essentially the same as described above for the second body 37.

Figure 8:
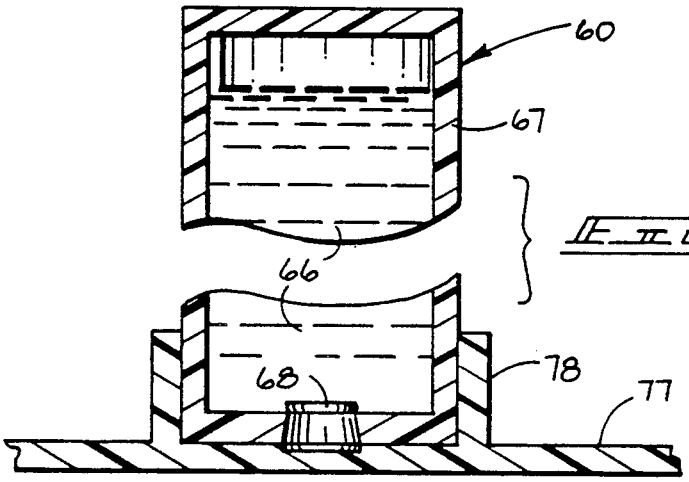
FIG. 8 is a fragmented sectional view taken substantially along line 8—8 in FIG. 7.

Either or both of the first or second bodies 60, 62 may be altered as suggested in FIG. 8 in which the body 67 shown is hollow and filled with a substantially transparent liquid such as water. Other transparent liquids may also be employed for this purpose. The hollow cylinder filled with water 66 or other transparent fluids effectively becomes substantially the optical equivalent of a solid body (with slight variations due to the refractive indices of the liquid and the material comprising the hollow body wall 69). Such bodies including hollow interiors will be provided with a filling hole and plug arrangement 68.

The variation shown in FIG. 9 simply employs an alternative form of base configuration 70 for rotatably supporting first body 71. This configuration also includes a joint 73 mounting the second body 72 to the first body 71.

The exemplified joint 73 is a receptacle arrangement, rotatably receiving the transparent first and second bodies in the particular angular orientation desired and such that the bodies will be relatively free to be rotated about their individual central axes 74, 75.

It is pointed out that alternatives of the joint 73 configuration are envisioned, including an inverted "L" configuration (not shown) with sockets similar to that shown in FIG. 7 to rotatably and removably receive the top end of, say, the first body shown in the FIG. 7 example. The horizontal leg of the "L" configuration would rotatably support the horizontal body angularly over the reflective surface 76, thereby doing away with the upright arm 56 mount configuration.

It is pointed out that other combinations and variations of the examples discussed above may be made without departing from the scope of this invention. For example, the sleeve 27 shown in FIG. 2 could also be provided on the several forms of the second body described above. The sleeve could also be applied to a first or second body of the type exemplified in FIG. 8. These and still further combinations or modifications may be made in view of the disclosure made herein.

Operation of any form of the present invention is accomplished in a very simple manner, as described in general terms below.

If two sets of hourly increments are provided the user will first set the upright first body according to the Hemisphere in which the indicator is to be used. This will bring the proper set of hourly indicia into position for reading time. Increments reading from right to left will be used in the Northern Hemisphere, while the set reading from left to right will be used in the Southern Hemisphere. If necessary, the body (FIG. 1), second body (FIGS. 7,9), or sleeve (FIG. 2) is inverted to properly orient the correct set of increments.

The preferred time to set the time indicator is at noon on a sunny day, although any time will be appropriate as long as the sun is out.

It is preferred that the present indicator be situated within an area with a southern exposure or, rather, an exposure that is oriented toward the equator. Thus, a south facing window is preferred in the northern hemisphere and a north facing window is preferred in areas south of the equator.

The time indicator is placed on a flat surface exposed to the sun. It is preferred to orient the device with the light receiving and refracting surfaces of the first body facing the equator. Next, the correct time is checked on a conventional timepiece. The indicia on the body are then rotated until the correct time indicia marking becomes aligned coincides with the intense axial column of light made visible by the image producing surface.

The transparent light refractive body is now set and will accurately mark the passage of time as the sun moves across the horizon and the concentrated axial column of light responsively moves across the second side of the body.

Figure 6:
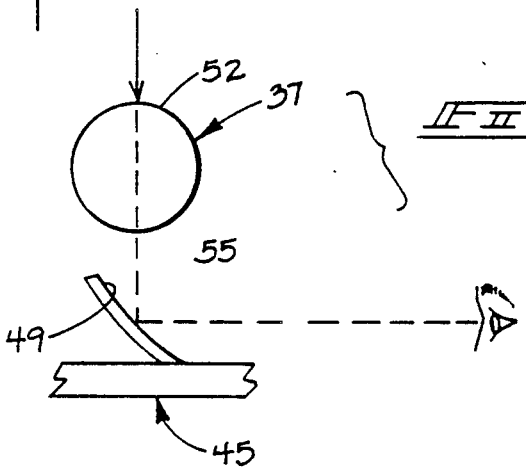
FIG. 6 is a diagrammatic view illustrating the properties of a reflective surface on a base member for the present time indicator.

In arrangements where a second horizontal body is provided, the seasonal adjustment is made by selectively rotating the indicia on the second body until the concentrated horizontal axial column of light on that body's image producing surface is visible in alignment with the current season identified by the indicia thereon. The appropriate reflector surface will accommodate this condition especially when the appropriate seasonal indicia is facing downwardly away from the viewer. The season may then be appropriately viewed as schematically indicated in FIG. 6 of the drawings.

The present time indicator 10 may also be set with a compass. This may be done by use of appropriate angular indicia 80 provided on the base or any other appropriate surface on the indicator. The markings are simply set such that a zero degree marking 81 is pointed toward the equator. Thus, the zero degree marking 81 will be pointed due south in the northern hemisphere and due north in the southern hemisphere. It is advisable to compensate for magnetic deviations in the latitude and longitude where the indicator is being positioned. Of course, in any latitude, north or south, the zero degree indicator should always point toward the equator.

Once set, the present time indicator 10 will create a very bright, highly visible line along the image producing surfaces that will move with the sun and indicate the hours and seasons.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

What is claimed is:

1. A visual time indicator responsive to a remote light source, comprising:

a transparent light refractive body having a continuously arcuate external surface formed about a central axis and extending along the axis;

said external surface having first and second sides;

an axial transparent light receiving and refracting surface on the first side of the body to focus light from the remote light source through the body and to produce a single concentrated axial column of light at any given time on the second side of the body opposite to the light receiving and refracting surface;

an axial image producing surface on the transparent light refractive body and on the second side thereof to visually display the single axial column of light; and calibrated indicia on the second side of the transparent light refractive body substantially diametrically opposed to the axial transparent light receiving and refracting surface, identifying a time increment visually relative to the axial column of light on the axial image producing surface.

2. The remote light source responsive visual time indicator as claimed by claim 1, wherein the calibrated indicia on the second side of the transparent light refractive body is superimposed over the axial image producing surface.

3. The remote light source responsive visual time indicator as claimed by claim 1, wherein the calibrated indicia on the second side of the transparent light refractive body is integral with the axial image producing surface.

4. The remote light source responsive visual time indicator as claimed by claim 1, wherein the transparent light refractive body is cylindrical.

5. The remote light source responsive visual time indicator as claimed by claim 1, further comprising:

a sleeve receivable over the transparent light refractive body; and wherein the calibrated indicia is located on the sleeve.

6. The remote light source responsive visual time indicator as claimed by claim 1, wherein the transparent light refractive body is hollow and adapted to be filled with a transparent liquid.

7. The remote light source responsive visual time indicator as claimed by claim 1, further comprising a base mounting the transparent light refractive body at an angle of between 5° and 45° to nadir and with the axial image producing surface thereof facing downwardly.

8. The remote light source responsive visual time indicator as claimed by claim 1, wherein the transparent light refractive body is cylindrical and further comprising a base mounting the transparent light refractive body at an angle of between 5° and 45° to nadir and with the axial image producing surface thereof facing downwardly, the base being formed by a bottom end surface of the cylindrical light refractive body.

9. The remote light source responsive visual time indicator as claimed by claim 1, further comprising a base mounting the transparent light refractive body for selective rotation about the central axis and with its central axis at an angle between 5° and 45° to nadir and with the axial image producing surface thereof facing downwardly.

10. The remote light source responsive visual time indicator as claimed by claim 1, wherein the transparent light refractive body is oriented at an angle of approximately 15° to nadir and with the axial image producing surface thereof facing downwardly.

11. The remote light source responsive visual time indicator as claimed by claim 1, wherein the transparent light refractive body is oriented at an angle of approximately 15° to nadir and with the axial image producing surface thereof facing downwardly, and further comprising a base for supporting the transparent light refractive body at the approximate 15° angle.

12. The remote light source responsive visual time indicator as claimed by claim 1, wherein the transparent light refractive body is oriented at an angle of approximately 15° to nadir and with the axial image producing surface thereof facing downwardly, and further comprising a base for supporting the transparent light refractive body at the approximate 15° angle and wherein the transparent light refractive body is substantially cylindrical.

13. The remote light source responsive visual time indicator as claimed by claim 1, wherein the light refractive body is in the form of a disk, and wherein the axial image producing surface thereof is formed as a beveled frusto-conical surface with respect to the central axis thereof.

14. The remote light source responsive visual time indicator as claimed by claim 1, wherein the light refractive body is in the form of a disk;

wherein the axial image producing surface thereof is formed as a beveled frusto-conical surface on the disk; and wherein the transparent light receiving and refracting surface is axially convex.

15. The remote light source responsive visual time indicator as claimed by claim 1, including two of the light refractive bodies, with a first of the two bodies being oriented with its central axis substantially upright, and a second of the two bodies with its central axis substantially horizontal;

wherein the calibrated indicia includes hourly increments on the first body, along the axial image producing surface thereof and further includes seasonal indicia on the axial image producing surface of the second body; and a base supporting the first and second bodies in their respective orientations.

16. The remote light source responsive visual time indicator as claimed by claim 15 wherein the first body is rotatable on the base about its central axis.

17. The remote light source responsive visual time indicator as claimed by claim 15 wherein the first and second bodies are rotatable about their respective central axes.

18. The remote light source responsive visual time indicator as claimed by claim 15 further comprising a joint mounting the second body to the first body for selective rotation about the central axis of the second body; and wherein the first body is rotatable about its respective central axis on the base.

19. The remote light source responsive visual time indicator as claimed by claim 15 wherein the first body is oriented between 5° and 45° to nadir and with the axial image producing surface thereof facing downwardly.

20. The remote light source responsive visual time indicator as claimed by claim 15 wherein the first body is oriented at approximately 15° to nadir and with the axial image producing surface thereof facing downwardly.

21. The remote light source responsive visual time indicator as claimed by claim 15 wherein the first body is substantially cylindrical.

22. The remote light source responsive visual time indicator as claimed by claim 15 wherein the second body is substantially cylindrical.

23. The remote light source responsive visual time indicator as claimed by claim 15 wherein at least one of the bodies is hollow and adapted to be filled with a transparent liquid.

24. The remote light source responsive visual time indicator as claimed by claim 15 wherein the second body is substantially cylindrical and wherein the first body is in the form of a disk.

25. The remote light source responsive visual time indicator as claimed by claim 15 wherein the second body is substantially cylindrical, wherein the first body is in the form of a disk, and wherein the axial image producing surface on said first body is formed as a beveled frusto-conical surface with respect to the central axis thereof.

26. The remote light source responsive visual time indicator as claimed by claim 15 wherein the second body is substantially cylindrical, wherein the first body is in the form of a disk, and wherein the axial image producing surface on said first body is formed as a beveled frusto-conical surface with respect to the central axis thereof; and wherein the axial transparent light receiving and refracting surface on said first body is axially convex.

27. The remote light source responsive visual time indicator as claimed by claim 15 wherein the axial transparent light receiving and refracting surface of the first body is axially convex.

28. The remote light source responsive visual time indicator as claimed by claim 15 wherein the base includes a reflective surface oriented to visually reflect seasonal indicia on the axial image producing surface of the second body.

29. The remote light source responsive visual time indicator as claimed by claim 15 further comprising a joint mounting the second body to the first body for selective rotation about the central axis of the second body;

wherein the first body is rotatable about its respective central axis on the base; and wherein the base includes a reflective surface oriented to visually reflect seasonal indicia on the axial image producing surface of the second body.

30. The remote light source responsive visual time indicator as claimed by claim 15 wherein the base includes a reflective surface oriented to visually reflect seasonal indicia on the axial image producing surface of the second body;

wherein the first body is in the form of a disk; and wherein the axial image producing surface of the first body is formed as a beveled frusto-conical surface with respect to the central axis thereof.

* * * * *